United States Patent [19]

Nagase et al.

[11] 4,063,936

[45] Dec. 20, 1977

[54] ALUMINUM ALLOY HAVING HIGH MECHANICAL STRENGTH AND ELONGATION AND RESISTANT TO STRESS CORROSION CRACK

[75] Inventors: Ikuo Nagase, Tokyo, Japan; Park Hee Sun, Seoul, South Korea

[73] Assignee: Alloy Trading Co., Ltd., Tokyo, Japan

[21] Appl. No.: 717,868

[22] Filed: Aug. 26, 1976

Related U.S. Application Data

[63] Continuation of Ser. No. 538,117, Jan. 2, 1975, abandoned.

[30] Foreign Application Priority Data

Jan. 14, 1974 Japan ..... 49-7383

[51] Int. Cl.[2] ..... C22C 21/10

[52] U.S. Cl. ..... 75/141; 75/146; 148/32.5; 148/159

[58] Field of Search ..... 75/141, 146; 148/32, 148/32.5, 159

[56] References Cited

U.S. PATENT DOCUMENTS

| | | | |
|---|---|---|---|
| 2,240,940 | 5/1941 | Nock | 75/141 |
| 2,245,167 | 6/1941 | Stroup | 75/141 |
| 3,198,676 | 8/1965 | Sprowls et al. | 75/141 |
| 3,762,916 | 10/1973 | Kirman | 75/141 |
| 3,794,531 | 2/1974 | Markworth et al. | 75/141 |
| 3,876,474 | 4/1975 | Watts et al. | 75/141 |

*Primary Examiner*—R. Dean

*Attorney, Agent, or Firm*—Young & Thompson

[57] ABSTRACT

An aluminum alloy having a high mechanical strength and elongation and resistant to stress corrosion cracking is disclosed which comprises 5 to 15% by weight of Zn, 0.3 to 1.5% by weight of Mg, 0.1 to 1.0% by weight of Zr, 0.1 to 1.0% by weight an alloying metal selected from the group consisting of Cu and Ag, and the remainder of Al and impurities normally present therein.

3 Claims, No Drawings

ALUMINUM ALLOY HAVING HIGH MECHANICAL STRENGTH AND ELONGATION AND RESISTANT TO STRESS CORROSION CRACK

This is a continuation, of application Ser. No. 538,117, filed Jan. 2, 1975, abandoned.

This invention relates to an aluminum alloy having a high mechanical strength and elongation and resistant to stress corrosion cracking.

An A*l*-Zn-Mg alloy containing a large amouht of Zn has a high mechanical strength, but is susceptible to stress corrosion cracking and as a result, it is valueless as an aluminum alloy adapted to be used in practice. Thus, heretofore, it has been the common practice to use A*l*-Zn-Mg alloys whose Zn content is less than 5% by weight, preferably 3% to 5% by weight.

An object of the invention is to provide an aluminum alloy having a high mechanical strength and elongation and resistant to stress corrosion cracking and further characterized by having an excellent workability.

A feature of the invention is the provision of an aluminum alloy having a high mechanical strength and elongation and resistant to stress corrosion cracking consisting essentially of 5 to 15% by weight of An, 0.3 to 1.5% by weight of Mg, 0.1 to 1.0% by weight of Zr, 0.1 to 1.0% by weight of an alloying metal selected from the group consisting of Cu and Ag, and the remainder of Al and impurities normally present therein.

In accordance with the invention, it has been found that the mechanical strength of a conventional Al-Zn-Mg alloy containing a large amount of Zn can be increased and that the presence of such large amount of Zn added with Zr together with an alloying metal selected from the group consisting of Cu and Ag can improve the stress corrosion crack resisting property of the alloy, thereby providing a novel *Al-Zn-Mg alloy having an excellent workability.*

The reasons why the Zn content is limited to 5 to 15% by weight, the Mg content to 0.3 to 1.5% by weight, the Zr content to 0.1 to 1.0% by weight and the alloying metal content to 0.1 to 1.0% by weight are as follows.

In the first place, if the Zn content is made less than 5% by weight, the mechanical strength of the alloy becomes low and if the Zn content is made more than 15% by weight, the workability of the alloy decreases. As a result, it is necessary to confine the Zn content to a range from 5 to 15% by weight.

Secondly, the presence of Mg is required for the purpose of making the supersaturated solid solution relatively stable and combining Mg with Zn to precipitate Mg $Zn_2$ which causes the alloy to exhibit an ageing characteristic. If the Mg content is made less than 0.3% by weight, the ageing characteristic is not exhibited and the mechanical strength is low and if the Mg content is made more than 1.5% by weight, the stress corrosion cracking accelerates. As a result, it is necessary to confine the Mg content to a range from 0.3 to 1.5% by weight.

Third, the presence of Zr with Cu or Ag serves to prevent the stress corrosion cracking. If the Zr content is made less than 0.1% by weight, it is impossible to prevent the stress corrosion crack and if the Zr content is made more than 1.0% by weight, the stress corrosion cracking becomes accelerates. As a result, it is necessary to confine the Zr content to a range from 0.1 to 1.0% by weight.

Finally, the presence of Ag or Cu together with Zr serves to prevent the stress corrosion cracking. If the Ag or Cu content is made less than 0.1% by weight, it is impossible to prevent the stress cracking, and if the Ag or Cu content is made more than 1.0% by weight, the stress corrosion cracking accelerates. As a result, it is necessary to confine the Ag or Cu content to a range from 0.1 to 1.0% by weight.

The alloy according to the invention will now be described in greater detail with reference to the following Tables 1 to 6.

In Table 1 are shown the results of chemical analysis of X-Cu-Zr and X-Ag-Zr (X is a basic composition according to the invention and consisting of about 10% by weight of Zn and about 1% by weight of Mg), balance essentially Al and the other Al alloys listed as reference examples.

Table 1

| Composition No. | Zn | Mg | Cu | Zr | |
|---|---|---|---|---|---|
| Alloy | | | | | |
| X | 9.8 | 0.89 | — | — | — |
| X-Ag | 10.2 | 0.92 | — | — | Ag=0.2 |
| X-Be | 10.4 | 0.95 | — | — | Be=0.2 |
| X-Bi | 10.2 | 0.93 | — | — | Bi=0.2 |
| X-Cu | 10.1 | 0.88 | 0.23 | — | — |
| X-Mn | 10.4 | 0.96 | — | — | Mn=O.2 |
| X-Fe | 10.2 | 0.91 | — | — | Fe=0.18 |
| X-Zr | 9.9 | 0.86 | — | 0.15 | — |
| X-Cr | 10.1 | 0.86 | — | — | Cr=0.21 |
| X-Cu-Cr | 10.1 | 0.88 | 0.22 | — | Cr=0.2 |
| X-Cu-Zr | 10.1 | 0.90 | 0.24 | 0.10 | — |
| A | 5.0 | 1.6 | — | — | — |
| B | 3.93 | 1.42 | 0.0013 | Fe=0.17 | Mn=0.35 Cr,Ti=0.004 |
| X-Ag-Zr | 10.15 | 1.02 | — | 0.25 | Ag=0.24 |

In the above Table 1, A is a pure A*l*-Zn-Mg ternary alloy particularly prepared for the purpose of comparing it with the other listed alloys and B is an A*l*-Zn-Mg alloy similar to A and used in practice.

Various kinds of alloys shown in Table 1 are immersed into a stress corrosion accelerating liquid to carry out stress corrosion cracking tests. The tests have yielded the results which are shown in the following Tables 2 and 3.

Table 2

| Heat treatment | T-4 | | T-6 | | T-7 | |
|---|---|---|---|---|---|---|
| | W.Q | A.C | W.Q | A.C | W.Q | A.C |
| Alloy | | | | | | |
| X | Δ | 1 | Δ | 2 | 3 | 2 |
| X-Ag | 2 | 6 | 2 | | 13 | Δ |
| X-Be | Δ | 1 | Δ | 3 | 5 | 3 |
| X-Bi | Δ | 2 | 1 | 2 | 6 | 5 |
| X-Cr | 3 | 5 | 3 | 7 | 7 | 20 |
| X-Cu | 11 | 1 | 1 | 1 | 20 | 7 |
| X-Fe | Δ | 1 | Δ | 1 | 1 | 3 |
| X-Mn | Δ | 1 | Δ | 2 | 6 | 3 |
| X-Zr | 20 | 30 | 20 | 40 | 60 | 90 |
| A | 20 | 50 | 55 | 90 | 140 | 250 |

Table 3

| Heat treatment | T-4 | | T-6 | | T-7 | |
|---|---|---|---|---|---|---|
| | W.Q | A.C | W.Q | A.C | W.Q | A.C |
| Alloy | | | | | | |
| X-Cu-Zr | o | o | o | o | o | o |
| X-Cu-Cr | 10 | 40 | 15 | 40 | 90 | 130 |
| X-Ag-Zr | o | o | o | o | o | o |

Table 3-continued

| Heat treatment | T-4 | | T-6 | | T-7 | |
|---|---|---|---|---|---|---|
| | W.Q | A.C | W.Q | A.C | W.Q | A.C |
| B | 290 | o | 340 | o | 380 | o |

In the above Tables 2 and 3, W·Q is an alloy subjected to quenching in water, A·C is an alloy cooled in the air, numerical values are time in units of minutes elapsed before cracks are produced in the alloy, Δ symbol shows that cracks are produced in the alloy within 1 minute, symbol shows that cracks are not produced for a time longer than 500 minutes, T-4 is one step heat treatment, T-6 is two step heat treatment and T-7 is three step heat treatment, these treatments being also shown in the following Table 5.

As seen from Table 2, all of the X-alloy, X-Ag alloy (containing 0.2% by weight of Ag), X-Be alloy (containing 0.2% by weight of Be), etc. become cracked at a time which is shorter than a time at which the A-alloy, that is, pure Al-Zn-Mg ternary alloy becomes cracked.

As seen from Table 3, both the X-Cu-Zr alloy consisting of the X alloy with 0.24% by weight of Cu and 0.10% by weight Zr and the X-Ag-Zr alloy consisting of the X alloy with 0.24% by weight of Ag and 0.25% by weight of Zr according to the invention are resistant to stress corrosion cracking and the stress corrosion crack resisting property thereof is far superior to those of the B alloy used in practice and of the other alloys shown in the Tables 2 and 3.

Representative compositions of the alloy according to the invention are exemplified in the following Table 4, but the invention is not limited to these examples.

Table 4

| Composition wt. % | Zn | Mg | Cu | Zr | Fe | Si |
|---|---|---|---|---|---|---|
| Alloy | | | | | | |
| 8-5M | 7.9 | 0.42 | 0.22 | 0.14 | 0.02 | 0.01 |
| 8-10M | 7.9 | 0.74 | 0.22 | 0.15 | 0.02 | 0.01 |
| 8-10M | 8.3 | 1.0 | 0.24 | 0.15 | 0.02 | 0.01 |
| 10-5M | 10.03 | 0.51 | 0.18 | 0.20 | 0.02 | 0.01 |
| 10-8M | 9.8 | 0.68 | 0.22 | 0.15 | 0.02 | 0.01 |
| 10-10M | 10.1 | 0.90 | 0.24 | 0.10 | 0.02 | 0.01 |
| 10-20M | 10.6 | 2.03 | 0.28 | 0.14 | 0.02 | 0.01 |
| 15-10M | 15.0 | 0.98 | 0.28 | 0.12 | 0.02 | 0.01 |
| 15-15M | 15.0 | 1.44 | 0.31 | 0.12 | 0.02 | 0.01 |
| 15-20M | 14.8 | 2.01 | 0.30 | 0.12 | 0.02 | 0.01 |

In the above Table 4, 8-5M is an alloy whose basic composition consists of about 8% by weight of Zn and about 0.5% by weight of Mg, 8-10M is an alloy whose basic composition consists of about 8% by weight of Zn and about 1.0% by weight of Mg, 10-5M is an alloy whose basic composition consists of about 10% by weight of Zn and about 0.5% by weight of Mg, etc.

Amount of Cr and Mn contained in all of the alloys according to the invention shown in the above Table 4 is less than 0.01% by weight.

In the following Table 5 are shown various kinds of heat treatments applied to the various alloys according to the invention shown in the above Table 4.

Table 5

| | Tempering °C | Ageing °C |
|---|---|---|
| T-4 | 0 | 60 |
| T-6 | 0 | 60→150 |
| T-7 | 0 | 60→150→190 |
| D.Q | 150 | 150 |
| S.Q | 190 | 90→150 |

In the above Table 5, D·Q is a direct quenching and S·Q is a step quenching.

The alloys according to the invention shown in the above Table 4 are subjected to the heat treatment shown in the above Table 5 and then subjected to mechanical test for measuring mechanical strength which is sufficient to prevent stress corrosion cracking. The results of such mechanical test are shown in the following Table 6.

Table 6

| Alloy | Heat treatment H-T | Hv | Hv max (T-6) | (Kg/mm²) σ0.2 | (Kg/mm²) σB | ε(%) |
|---|---|---|---|---|---|---|
| 8-5M | T-6 | 120 | 120 | 35.0 | 40.3 | 12.4 |
| 8-8M | T-6 | 140 | 140 | 42.5 | 47.5 | 11.2 |
| 8-10M | T-6 | 150 | 150 | 46.3 | 50.6 | 11.0 |
| 10-5M | T-4 | 130 | 130 | 34.8 | 47.7 | 14.1 |
| " | T-6 | 127 | 127 | 35.4 | 44.8 | 11.7 |
| 10-8M | T-6 | 150 | 150 | 44.8 | 50.0 | 11.3 |
| 10-10M | T-4* | 150 | 155 | 39.6 | 52.9 | 12.3 |
| " | T-6* | 150 | 155 | 43.5 | 51.5 | 12.6 |
| " | T-7 | 150 | 160 | 45.6 | 50.6 | 7.9 |
| 10-20M | T-7 | 175 | 200 | 54.9 | 56.7 | 5.4 |
| " | D.Q | 180 | 200 | 55.1 | 60.1 | 6.3 |
| " | S.Q | 185 | 200 | 56.8 | 62.9 | 4.0 |
| 15-10M | D.Q | 165 | 183 | 48.6 | 53.4 | 6.5 |
| 15-15M | D.Q | 165 | 195 | 56.0 | 54.4 | 8.5 |
| 15-20M | D.Q | 160 | 205 | 45.8 | 51.6 | 77.5 |

In the above Table 6, T-4* and T-6* are heat treatments in which the alloy 10-10M is gradually cooled from its melting temperature in the air, the other alloys being heat treated as shown in the above Table 5.

In the above Table 6, Hv is the maximum mechanical strength of the alloy expressed in Vickers hardness which shows no cracks are produced until 500 minutes when the alloy is subjected to the stress corrosion crack test, Hv max is the maximum hardness value of the alloy subjected to the T-6 heat treatment, σ0.2 (Kg/mm²) is the yield strength of the alloy subjected to 0.2% yield test, σ is the tensile strength of the alloy and ε is the elongation percentage of the alloy.

As seen from the Table 6, the alloy according to the invention has a significantly high mechanical strength and elongation, this high mechanical strength being sufficient for preventing stress corrosion cracking.

As stated hereinbefore, the alloy according to the invention containing a considerably larger percentage of Zn than conventional Al-Zn-Mg alloy has increased mechanical strength. In addition, the alloy according to the invention with Cu-Zr or Ag-Zr has improved yield strength against stress corrosion cracking and elongation and is generally suitable as a construction material comparable with iron and steel. The alloy according to the invention may be used for other various applications.

What is claimed is:

1. An aluminum alloy having a high mechanical strength and elongation and resistant to stress corrosion cracking, consisting essentially of about 10% by weight of Zn, about 1% by weight of Mg, 0.1 to 1.0% by weight of Zr, 0.1 to 1.0% by weight of an alloying metal selected from the group consisting of Cu and Ag, balance essentially Al.

2. An aluminum alloy as claimed in claim 1, in which said alloying metal is copper.

3. An aluminum alloy as claimed in claim 1, in which said alloying metal is silver.

* * * * *